United States Patent [19]

Kuus et al.

[11] 4,127,790

[45] Nov. 28, 1978

[54] HIGH-PRESSURE DISCHARGE LAMP

[75] Inventors: Gijsbert Kuus; Adriaan J. de Ridder, both of Eindhoven, Netherlands

[73] Assignee: U.S. Philips Corporation, New York, N.Y.

[21] Appl. No.: 834,951

[22] Filed: Sep. 20, 1977

[30] Foreign Application Priority Data

Oct. 8, 1976 [NL] Netherlands ..... 7611137

[51] Int. Cl.[2] ..... H01J 61/26

[52] U.S. Cl. ..... 313/174; 417/48

[58] Field of Search ..... 313/174, 176, 178; 417/48

[56] References Cited

U.S. PATENT DOCUMENTS 3,953,755 4/1976 Kuus et al. ..... 313/174

*Primary Examiner*—Rudolph V. Rolinec
*Assistant Examiner*—Darwin R. Hostetter
*Attorney, Agent, or Firm*—Frank R. Trifari; Robert S. Smith

[57] ABSTRACT

A high-pressure discharge lamp having a hydrogen getter in the lamp vessel disposed in a metal envelope which is hydrogen-permeable. The hydrogen-permeable metal of the envelope is covered with a porous halogen-resistant layer. The atoms of the metal halides dissociated in the discharge can recombine at the porous layer so that blackening of the discharge vessel is mitigated.

3 Claims, 3 Drawing Figures

HIGH-PRESSURE DISCHARGE LAMP

The invention relates to a high-pressure discharge lamp having a discharge vessel comprising electrodes, a gas filling and a hydrogen getter in a metal envelope, which is hydrogen permeable.

Such lamps are known from German Offenlegungsschrift No. 2,452,044. In the known lamps the hydrogen getter is enclosed in an envelope of hydrogen-permeable metal in order to protect the getter against attack by the gas filling.

It has been found that in lamps which have a long life and the gas filling of which contains metal halides, blackening of the discharge vessel may occur. This is the case notably in halide lamps of lower (400 W or less) powers. The black deposition proves to consist of the hydrogen-permeable metal of the envelope of the getter which in the long run apparently cannot withstand entirely the conditions prevailing in the lamp during operation.

It is the object of the invention to provide means to mitigate the blackening of the discharge vessel.

In high-pressure discharge lamps of the kind mentioned in the preamble this object is achieved according to the invention in that the hydrogen-permeable metal of the envelope of the getter is covered with a porous halogen-resistant layer.

The layer may be, for example, tungsten, molybdenum, a nitride, carbide or oxide of a lanthanide, of yttrium, scandium, aluminium, zirconium or of hafnium. Porous layers of said materials can be obtained according to known methods, for example, by means of plasma spraying.

It is to be noted that it is known from Netherlands Patent Application No. 7,016,726 laid open to public inspection to envelop a getter of a mercury vapour gas discharge tube by porous, sintered tungsten. The pores of the sintered material are inaccessible for mercury atoms but do pass through the gases to be gettered.

Such a selectivity for the porous envelope of the hydrogen getter is not endeavoured in lamps according to the invention and is not necessary either. In lamps according to the invention, the metal, hydrogen-permeable envelope as a matter of fact prevents already that large atoms, such as mercury atoms, can penetrate to the getter. Nor is it necessary for the pores of the porous material to be too narrow for halogen.

In lamps having a metal halide-containing gas filling, dissociation of the metal halide occurs during operation. In the convection currents occurring in the lamp free halogen atoms and metal atoms therefore occur.

The invention is based on the recognition that said halogen reacts with the hydrogen-permeable metal of the getter envelope and that said reaction can be prevented by separating the metal of the envelope from the convection currents by a porous layer on which the metal atoms and halogen atoms originating from the metal halide are given the opportunity to recombination. From experiments in which the enveloped getter without a porous covering layer was heated in the same gas mixture as is provided in a discharge lamp but in which as a result of the absence of a discharge no dissociation of metal halide occurred, it has been found as a matter of fact that the envelope can withstand non-dissociated metal halide.

The metal envelope of the hydrogen getter need not be entirely of hydrogen-permeable metal. For example, for the gettering effect it is already sufficient when only the wall of the metal envelope facing the discharge is hydrogen-permeable, whereas the remaining walls are not or not substantially hydrogen-permeable.

As a hydrogen-permeable metal may be used, for example, tantalum, niobium, vanadium, nickel, iron, alloys of at least two of these metals and alloys of tungsten or molybdenum with at least 5 atom% of at least one of the said materials.

If only a part of the area of the metal envelope of the hydrogen getter is of hydrogen-permeable material, the coating with the porous halogen-resistant layer may be restricted to said part, since for the remaining part of the envelope of the getter a metal may be chosen which can withstand halogen better. However, the remaining part of the envelope which consists, for example, of tungsten, molybdenum or alloys thereof, may also be covered with a porous layer. This may be preferred, for example, for simplifying manufacture.

As hydrogen-gettering materials may be mentioned scandium, yttrium, lanthanum, lanthanides and alloys thereof.

The porous halogen-resistance layer is generally chosen to be 50 to 150 μm thick, although a thickner layer may also be used or a thinner layer may suffice.

If the envelope of the hydrogen getter consists entirely or partly of nickel or iron, it is preferable to maintain the getter spaced from the envelope or from that part of the envelope, for example, by means of spacers, such as spacer rings, or by means of a porous separation layer, for example, consisting of the materials which may be used for the external coating of the getter envelope.

The metal envelope of the hydrogen getter is as a rule approximately 5–500 μm thick when formed from foil, but is 0.1 to 100 μm thick when formed by depositing metal from a vapour phase directly onto the getter.

High-pressure discharge lamps according to the invention usually comprise a metal halide, in addition to mercury vapour and a rare gas as a starter gas, but the lamps may also comprise sodium vapour and possibly mercury vapour and rare gas as a gas filling.

The invention also relates to a hydrogen getter in a metal, hydrogen-permeable envelope suitable for use in a high-pressure discharge lamp, characterized in that the hydrogen-permeable metal of the envelope is covered with a porous halogen-resistant layer.

Embodiments of the lamp and the getter according to the invention are shown in the Figures.

Figure 1:
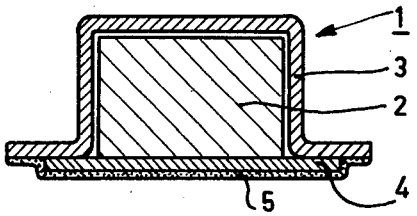
FIG. 1 is a sectional elevation on an enlarged scale of an enveloped getter.

The enveloped getter 1 of FIG. 1 has a hydrogen-gettering material 2 which is enclosed in a metal envelope consisting of a metal, hydrogen-permeable cover part 4 and a metal bottom part 3 which is impervious to hydrogen. The cover part 4 is covered with a porous, halogen-resistant layer 5.

Figure 2:
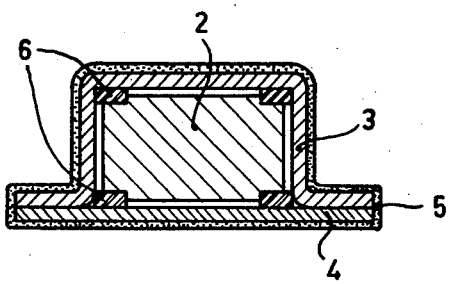
FIG. 2 is a sectional elevation of a modified embodiment of the getter.

In FIG. 2 both the bottom part 3 and the cover part 4 of the envelope of the gettering material 2 are of hydrogen-permeable metal. The gettering material is spaced from the metal envelope by means of spacer rings 6. The whole envelope is coated with a porous covering layer 5.

Figure 3:
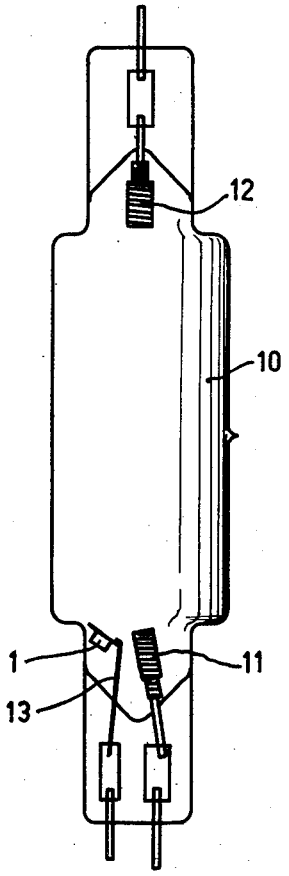
FIG. 3 shows a high-pressure discharge lamp.

In FIG. 3, the discharge vessel 10 has two electrodes 11 and 12 between which the discharge takes place during operation. Beside the electrode 11 an auxiliary electrode 13 is provided to facilitate the ignition of the lamp. The getter 1 of FIG. 1 is secured to the auxiliary electrode.

EXAMPLE

In a practical case the quartz glass lamp vessel of a high-pressure mercury vapour discharge lamp with halide additions (FIG. 3) and an inside diameter of 15 mm. The distance between the electrodes was 41 mm. The lamp vessel contained in addition to argon as a starter gas a quantity of mercury which evaporates entirely during operation, as well as sodium halide, thallium halide and indium halide. The lamp vessel was accommodated in a glass outer envelope.

An yttrium cylinder of 1.6 mm diameter and 1 mm height, weight approximately 10 mg, was accommodated in a tungsten flanged pot of 100 $\mu$m wall thickness which was sealed in a gas-tight manner with a tantalum disc of 100 $\mu$m thickness by means of resistance welding. The disc was covered by a 100 $\mu$m thick porous tungsten layer obtained by plasma spraying. The enveloped getter was connected by resistance welding to a tungsten wire which served as an auxiliary electrode.

During operation the lamp consumed a power of 400 W. The temperature of th getter was approximately 900° C.

After a few thousand hours in operation the lamp envelope was still bright.

What is claimed is:

1. A high-pressure discharge lamp which comprises a discharge vessel, first and second electrodes, a gas filling, a hydrogen getter, a metal envelope having a portion which is hydrogen permeable disposed about said hydrogen getter and a porous halogen resistant layer covering said portion of said envelope which is hydrogen-permeable metal.

2. A high-pressure discharge lamp as claimed in claim 1 wherein said porous covering layer consists of a metal selected from the group consisting of tungsten, molybdenum, a nitride, carbide or oxide of a lanthanide, of yttrium, scandium, aluminium, zirconium or of hafnium.

3. An assembly for use in an associated high-pressure discharge lamp which comprises a hydrogen-permeable envelope and a hydrogen getter disposed in said envelope, said hydrogen-permeable metal of the envelope being covered with a porous halogen-resistant layer.

* * * * *